US006136376A

United States Patent [19]

Maassel et al.

[11] Patent Number: 6,136,376

[45] Date of Patent: Oct. 24, 2000

[54] PROCESS FOR TREATING METAL ROLLS

[75] Inventors: James L. Maassel, New Bavaria; Morton R. Smith, Napoleon, both of Ohio; Windsor J. Davies, Florence, Ala.

[73] Assignee: Macro Specialty Industries, Inc., Napoleon, Ohio

[21] Appl. No.: 09/178,183

[22] Filed: Oct. 23, 1998

[51] Int. Cl.[7] ..... B05D 1/18; B05D 3/00; B05D 3/02

[52] U.S. Cl. ..... 427/318; 427/299; 427/314; 427/327; 427/409; 427/430.1; 427/435

[58] Field of Search ..... 428/421, 422, 428/457, 461, 463; 427/299, 314, 318, 327, 430.1, 435, 409; 492/53, 56, 54; 29/895

[56] References Cited

U.S. PATENT DOCUMENTS 3,574,071 4/1971 Covino ..... 204/38
3,942,230 3/1976 Nalband ..... 29/132
4,145,326 3/1979 Blackwell ..... 260/26.9 F
4,582,632 4/1986 Rokujo et al. ..... 252/502
5,843,526 12/1998 Lukacs, III et al. ..... 427/228

*Primary Examiner*—Vivian Chen
*Attorney, Agent, or Firm*—Donald R. Fraser

[57] ABSTRACT

A process for treating the surface of a metal roll, to extend the rolling campaign of the roll and ultimately the work life of the roll in a metal forming operation, comprises the steps of heating the metal roll surface to a temperature of at least 100 degrees F., and enveloping the metal roll in a bath of perfluoroethylene resin and an aliphatic naphthene solvent for a time sufficient to coat the surface of the metal roll with the perfluoroethylene resin.

6 Claims, No Drawings

PROCESS FOR TREATING METAL ROLLS

FIELD OF THE INVENTION

The present invention relates to a process for treating metal rolls. More particularly, the inventive process is directed to a process for treating the surfaces of metal rolls used in rolling mills, to extend roll life between resurfacing treatments, and to improve the consistency surface finish of the rolled material. The inventive process effectively extends the life of the metal rolling mill rolls.

BACKGROUND OF THE INVENTION

It is well-known to use a rolling mill, comprising a series of cooperating metal rolls having an increasingly narrower nip, to cold work or hot work a metal billet. Due to friction and heat, these rolls deteriorate rapidly, causing imperfections in the surface of the rolled material. Generally, the rolling mill must be shut down at frequent intervals in order to remove the rolls for refurbishment or to re-dress the remove the rolls for refurbishment or to re-dress the surfaces of the rolls in-situ. Frequent roll replacements and in-situ roll treatments cause the cost for rolling metal bar or plate stock to escalate sharply.

It would be desirable to devise a process for treating the surface of a metal roll to increase its working life; thus reducing the number of roll changes and roll treatments required in order to roll a quantity of metal stock.

SUMMARY OF THE INVENTION

Accordant with the present invention a process for treating the surface of a metal roll, to increase the working life of the metal roll, has surprisingly been discovered. The process comprises the steps of:

heating the metal roll surface to a temperature of at least 100 degrees F.; and enveloping the metal roll in a bath of a perfluoroethylene resin for a time sufficient to coat the surface of the metal roll with the perfluoroethylene resin.

Also contemplated by the present invention is a perfluoroethylene-coated metal roll produced by the inventive process.

The process for treating the surface of a metal roll according to the present invention is particularly well suited for treating and thereby extending the working campaign between roll changes and ultimately extending the working life of the rolls of a rolling mill.

DETAILED DESCRIPTION OF THE PREFERRED EMBODIMENT

The process for treating a metal roll according to the present invention comprises heating the metal roll surface to a temperature of at least 100 degrees F., and enveloping the metal roll in a bath of a perfluoroethylene resin for a time sufficient to coat the surface of the metal roll with the perfluoroethylene resin.

The inventive process may be used with various types of metal rolls including, but not necessarily limited to, steel rolls, nickel rolls, titanium rolls, and coated steel rolls such as, for example, inconel or chromium plated steel rolls.

Typically, when a metal roll is removed from a rolling mill for re-surfacing or other treatment, the metal roll is first ground to a precision surface finish then thoroughly cleaned by a solvent based process. This process removes rolling lubricants and other contaminants from the surface of the roll. Any conventional metal surface-cleaning solvent may be used. A particularly preferred solvent comprises a napthenic petroleum solvent available from Macro Specialty Industries, Inc. of Napoleon, Ohio under the product designation "MSI METAL TREATMENT SOLUTION 09621." As will be readily apparent to one ordinarily skilled in the art, a brand new metal roll may possibly be treated according to the present invention without a solvent pre-treatment step.

The metal roll surface is heated to a temperature of at least 100 degrees F., according to the present invention, by any conventional method. Preferably, the metal roll surface is heated to a temperature of at least 140 degrees F. The metal roll surface may be heated by convective or conductive energy transfer, or may simply be passed through a conventional metal heat-treating oven. While not wishing to be bound by any particular theory regarding the precise mechanism by which the inventive process imparts an extended working life to the surface of the treated metal roll, it is believed that the heating process expands microscopic surface aspirates which, during the coating process, receive the perfluoroethylene polymer, and which microscopic surface aspirates thereafter grasp the solidified perfluoroethylene polymer contained therein upon cooling.

The heated metal roll is thereafter enveloped in a bath of a perfluoroethylene resin for a time sufficient to coat the surface of the metal roll with the perfluoroethylene resin, according to the present invention. A preferred perfluoroethylene is polytetrafluoroethylene. The perfluoroethylene resin may be solubilized in an organic liquid such as, for example, an aliphatic naphtha solvent. A particularly preferred bath comprises about 60% by weight of an aliphatic naphtha solvent and about 40% by weight of a perfluoroethylene resin available from Macro Specialty Industries, Inc. of Napoleon, Ohio under the product designation "MSI TOOL COAT 09623."

The metal roll is enveloped in the perfluoroethylene resin for a period of time sufficient to coat the surface of the metal roll with the perfluoroethylene resin. Generally, the perfluoroethylene bath is recirculated as is well-known in the industry. Methods for enveloping by recirculating a bath may comprise, for example, inserting a stirrer into the bath, or pumping a stream of the bath liquid from one part of the bath to another. The time for circulating the bath is not sharply critical and may vary over wide limits from a few minutes to several hours. It has been observed that excellent results may be obtained by circulating the bath for a period of about 30 minutes.

After the bath has been recirculated for the required period of time, the metal roll may be removed from the perfluoroethylene bath and allowed to cool to ambient temperature. Thereafter, the metal roll may be inserted into a rolling mill and employed in the reduction of metal strip or flat stock.

The process according to the present invention appears to seal the metal roll microscopic surface aspirates, thereby preventing the entry thereinto of contaminants, including hydrogen molecules which could cause embrittlement. Additionally, the inventive treatment appears to impart lubricity to the metal roll surface, thereby reducing the coefficient of friction experienced during the rolling process, which in turn reduces the build-up of frictionally induced heat.

COMPARISON

A Number 10 four-high rolling mill having conventional 2½" by 11" steel rolls with 9" backup rolls is used to reduce billets of tungsten carbide measuring approximately 16'6" long by about 0.047" thick to a final thickness of about 0.006". The reduction is accomplished by passing the tungsten carbide billets backwards and forwards through the roll bite about 14 times.

It is observed that the roll work life averages about 5 billets of tungsten carbide, before the rolls must be changed. The average time required to roll each billet is about 72 minutes. After about 3 billets are rolled, two pockets begin to appear as "quarter buckle" at about 1" from each side of the work piece. As additional billets are rolled, these pockets intensify until the surface of the work piece is declared to be out of flatness specification. This occurs as about the fifth billet is processed.

It is believed that this "quarter buckle" phenomenon is caused by unequal heat patterns building up on the roll face. As the billet is rolled, heat energy accumulates at the roll surface. This accumulated heat cannot be dissipated evenly, resulting in excessive roll expansion in the "quarter buckle" area, and an uneven gage in the work piece.

EXAMPLE

Conventional steel rolls measuring 2½" by 11" are heated to a temperature of about 145 degrees F., and thereafter immersed in a bath of perfluoroethylene resin comprising about 60 weight percent aliphatic naphtha solvent and about 40 weight percent perfluoroethylene resin (MSI TOOL COAT 09623). The bath is recirculated for a period of about 30 minutes, after which the rolls are removed from the bath and allowed to cool to ambient temperature.

The coated rolls are installed into a Number 10 four-high rolling mill having 9" backup rolls. The rolling mill is then used to reduce billets of tungsten carbide measuring approximately 16'6" long by about 0.047" thick to a final thickness of about 0.006". This is accomplished by passing the tungsten carbide billets backwards and forwards through the roll bite about 14 times.

After the third billet is rolled, it is observed that the work piece is free of "quarter buckle." After the fifth billet is processed, it is observed that the resultant work price has superior flatness, and the lack of discoloration of the rolls and strip is comparable to that observed with new untreated steel rolls.

Rolling of billets continues through the twelfth billet, and it is observed that the resultant strip produced from each billet is well within flatness specifications.

The foregoing Example, in which the work life of conventional steel rolls is extended by approximately 245% by the treating process according to the present invention, may be repeated with similar success by substituting the generically and/or specifically described materials and/or process conditions for those set forth in the Example.

From the foregoing description, one ordinarily skilled in the art can easily ascertain the essential characteristics of the invention and, without departing from its spirit and scope, can make various changed and modifications to adapt the invention to various uses and conditions.

What is claimed is:

1. A process for treating the surface of a metal roll, comprising the steps of:

heating the metal roll surface to a temperature of at least 100 degrees F.; and enveloping the metal roll in a bath of a perfluoroethylene resin and an aliphatic naphthene solvent for a time sufficient to coat the surface of the metal roll with the perfluoroethylene resin.

2. The process for treating the surface of a metal roll according to claim 1, wherein the metal roll comprises a steel roll.

3. The process for treating the surface of a metal roll according to claim 1, wherein the metal roll surface is heated to a temperature of at least 140 degrees F.

4. The process for treating the surface of a metal roll according to claim 1, wherein the perfluoroethylene resin comprises a polytetrafluoroethylene resin.

5. The process for treating the surface of a metal roll according to claim 1, wherein the metal roll resides in a circulating bath of the perfluoroethylene resin for about 30 minutes.

6. The process for treating the surface of a metal roll according to claim 1, further comprising the step of solvent cleaning the metal roll prior to heating the metal roll.

* * * * *